US005423692A

United States Patent [19]

Francis

[11] Patent Number: 5,423,692

[45] Date of Patent: Jun. 13, 1995

[54] POWER CONNECTOR SET

[75] Inventor: Leonard J. Francis, Waterbury, Conn.

[73] Assignee: Litton Systems, Inc., Watertown, Conn.

[21] Appl. No.: 148,210

[22] Filed: Nov. 5, 1993

[51] Int. Cl.[6] ..... H01R 4/50

[52] U.S. Cl. ..... 439/335; 439/750; 439/452; 439/825

[58] Field of Search ..... 439/332, 335, 825, 449, 439/452, 314–319, 470, 660, 670, 671, 692, 693, 738, 750

[56] References Cited

U.S. PATENT DOCUMENTS

| | | | |
|---|---|---|---|
| 2,366,747 | 1/1945 | Moody | 439/335 |
| 2,851,670 | 9/1958 | Senior | 439/825 |
| 3,675,189 | 7/1972 | Smith | 439/825 X |
| 3,725,840 | 4/1973 | Hesse | 439/335 |
| 3,851,946 | 12/1974 | Piaget et al. | 439/825 X |
| 4,374,607 | 2/1983 | Bright et al. | 439/825 |
| 5,015,195 | 5/1991 | Piriz | 439/825 X |
| 5,066,242 | 11/1991 | Martucci | 439/825 X |

*Primary Examiner*—Khiem Nguyen
*Attorney, Agent, or Firm*—Michael H. Wallach

[57] ABSTRACT

A single-pole electrical connector adapted for carrying high electrical current comprises a conductive receptacle member adapted to be coupled to an electrical cable; a conductive plug member adapted to be coupled to an electrical cable; said receptacle member incorporating a pin contact portion; said pin contact portion comprising a rod-like member; said plug member incorporating a socket contact portion; said receptacle member and said plug member being adapted for sliding mechanical engagement along a common longitudinal axis; said rod-like member having an external diameter slightly larger than the diameter of said socket contact portion being provided with at least one pair of resilient finger members formed by fabricating at least one diametrically extending slot thereacross; each of said finger members extends radially outwardly with respect to the longitudinal axis of said pin contact portion as a result of the formation of said slot, whereby the external diameter of a pair of opposite finger members is greater relative to said external diameter of said rod-like member before the formation of said slots; said finger members being further adapted to be compressed in a radial direction and to engage a corresponding surface of said socket contact member when said receptacle member and said plug member are engaged.

10 Claims, 1 Drawing Sheet

52
22
20
30
4
38
39
42
32
12
36
51
18
10
33
37
55
53
43
41
13
14
16
28
26
34
8
24
58
23
35
40
61
57
54

POWER CONNECTOR SET

BACKGROUND OF THE INVENTION

The present invention relates to electrical connectors and, more particularly, to connectors which are particularly suitable for high current applications in the approximate range between 100–400 amperes.

High capacity connectors are, of course, well-known in the art. However, most designs are expensive to manufacture and cumbersome to use, especially in applications where mating and disconnecting must be accomplished frequently, especially in circumstances where power must be made available for short periods of time or temporarily.

Furthermore, known designs lack adequate safety features, such as means to prevent potentially hazardous accidental disconnection or cross mating of different cables which may transmit the wrong type of power to a piece of equipment.

SUMMARY OF THE INVENTION

The present invention eliminates the disadvantages of known high-power electrical connectors by providing a pair of contacts which are readily mated or disconnected. A keying feature is provided to prevent the cross-mating of connectors coupled to incompatible power lines. Furthermore, when mated, the contacts are locked to prevent inadvertent disconnection.

BRIEF DESCRIPTION OF THE DRAWINGS

A better understanding of the present invention and of the objects and advantages thereof will be obtained by reference to the following description taken in connection with the accompanying drawings, in which.

DESCRIPTION OF THE PREFERRED EMBODIMENT

Figures 1, 2, 3, 4, 5, 6, 7, 8:
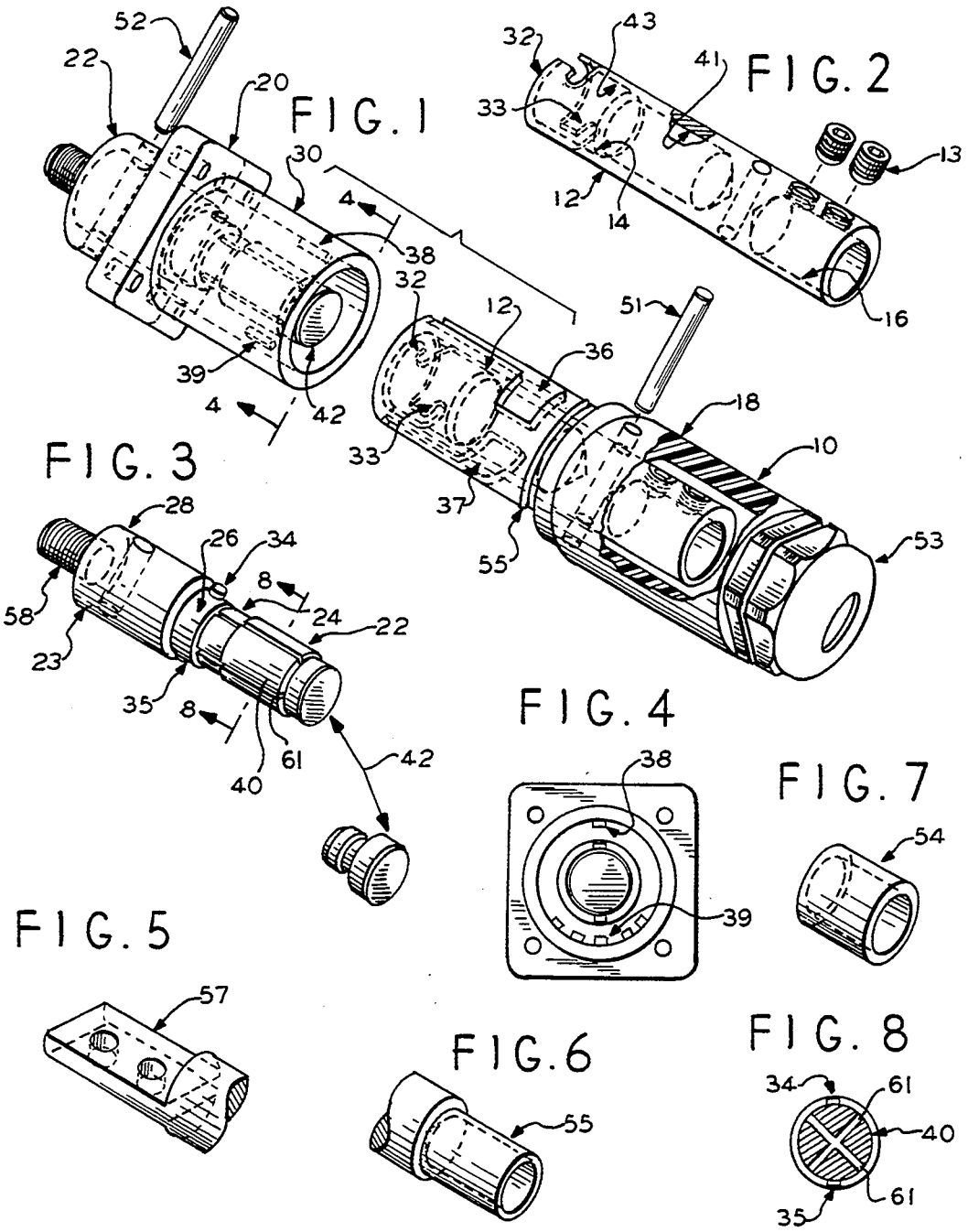
FIG. 1 is an elevation of a plug and receptacle according to the invention.
FIG. 2 is an elevation of the socket contact forming part of the plug portion of the invention.
FIG. 3 is an elevation of the pin contact member forming part of the receptacle portion of the invention.
FIG. 4 is an elevation of the receptacle portion of the invention viewed from line 4—4 of FIG. 1.
FIG. 5 is an elevation of a straight buss type termination for use in joining an electrical cable to the receptacle portion of the invention.
FIG. 6 is an elevation of one type of crimp or solder type termination for use in joining an electrical cable to the socket contact portion of the invention.
FIG. 7 is an elevation of an elastomeric bushing for use in forming a water resistant seal around the outer jacket of the terminated electrical cable in accordance with the invention.
FIG. 8 is a sectional view of the pin contact member taken along line 8—8 of FIG. 3.

Referring to FIG. 1, a single-pole power connector set adapted for high current applications comprises a plug 10 and receptacle 20.

As shown in FIG. 2, plug 10 comprises an elongated cylindrical socket contact member 12 of conductive material, such as copper alloy or other high-conductivity metal. Each end of contact 12 is bored or hollowed out, thereby forming a socket 14 and chamber 16, both of which are also generally cylindrically shaped. In the preferred embodiment, socket 14 and chamber 16 are non-communicating. It is to be understood, however, that the entire length of contact 12 may be bored straight through.

Referring to FIG. 3, receptacle 20 comprises a conductive pin member 23, also made of copper alloy or other high-conductivity metal, which includes first, second, third and fourth sections, 22, 24, 26, 28, respectively, each of which has a cylindrical external configuration and which lie along a common longitudinal axis. The socket 14 in contact 12 of plug 10 is adapted to receive the first, second and third sections 22, 24, 26 of pin 23, in coupling relation, to thereby establish electrical contact between plug 10 and receptacle 20.

Plug 10 and receptacle 20 are each provided with external shells or skins 18, 30, respectively, made of suitable insulating material. For example, such insulation may comprise impact-resistant thermoplastic which may be variously color-coded to provide quick identification of mating pairs of connectors. Shells 18 and 30 are disposed along the outer surface of pin 23 and socket contact 12, respectively.

Referring to FIG. 4, each mating set of connectors is also provided with a polarized keying feature 38, 39 to prevent cross-mating of wrong connectors.

Contact 12 of plug 10 is provided with a pair of L-shaped slots or keyways 32, 33 machined, in the preferred embodiment 180 degrees apart, and disposed at the outer edge thereof. As also shown in FIG. 8, a pair of pins or studs 34, 35, separated by 180 degrees, radially extend from section 26 of pin 23 and are adapted to engage keyways 32, 33 within socket contact 12 of plug 10 when the latter is coupled with receptacle 20. This allows the pin and socket to interlock during mating via a clockwise twisting motion, which in the preferred embodiment would be approximately 45 degrees of rotation. In addition, a pair of L-Shaped keyways 36, 37 formed within the insulating shell 18 of plug 10 mates with a corresponding pair of keying tabs 38, 39 formed within the interior wall of the plastic shell 30 of receptacle 20 (as also shown in FIG. 4). A twisting motion allows mating of the tabs 38, 39 with corresponding keyways 36, 37. An additional interlock is thereby provided to help prevent accidental separation of the mated connectors while under power.

The front internally-bored portion of contact 12 forms a socket 14 over a substantial portion of its length. The large diameter front entry portion 43 of socket 14 in which keyways 32, 33 are located, is followed by a "stepped down" transition to the smaller-bored diameter 41 over the remaining depth of socket 14, it being understood that both diameters are concentric to each other.

In order to enhance the degree of electrical contact between pin contact 23 and socket contact 12, the former is provided with a number of fingers 40 which extend longitudinally along the axis of pin 23. Fingers 40 are formed by forming slots 61 (here shown as four, but which can be any suitable number) across the rod-like diameter of sections 22 and 24 of pin body 23. Prior to slotting, the overall external diameter of fingers 40 is slightly larger than bore 41. When the slots 61 are cut, the material relaxes and the fingers 40 spread outward in a radial direction. As each finger is now effectively a spring member, assisted by the smaller diameter of section 24, insertion of spring fingers 40 into bore 41 provides an interference fit and excellent conductivity.

Stated in another way, section 24 of pin 23 is relieved by making its diameter smaller than that of section 22 to provide natural splay and spring qualities to fingers 40. The resultant diameter of spring fingers 40 is larger than the stepped-down diameter portion 41 of the internal bore of socket contact 12 and, upon entry into the bore, the spring fingers 40 depress slightly in a radial direction towards the longitudinal axis of pin 23 to establish a mechanically firm, low resistance electrical contact. Spring fingers 40 are designed to depress sufficiently enough so as to not exceed the elastic limit of the copper alloy, thus ensuring long life. This design differs from the popular "banana plug" in that the spring fingers 40 never need be pried apart to remedy weakened contact forces occasioned by continued use.

To enhance the safety of the design, a plastic safety plug 42 may optionally be provided. Plug 42 may be press-fitted, threaded or otherwise installed into the outer edges of the spring fingers 40 at the front of the pin body 23 thereby providing a "dead front" to guard against accidental contact of the conductive surface of the pin contact by the operator.

In one preferred embodiment, receptacle 20, including pin contact 23, is intended to be connected to the source of power, thereby constituting the hot side; while the plug 10, including socket contact 12, serves as the ground, drain, or cold side. Alternatively, and equally preferred, plug 10 may be incorporated into pin contact 23, while receptacle 20 may be incorporated into socket contact 12.

Cable termination to the rear of the plug 10 is achieved by inserting the end of a cable (not shown) into chamber 16 of socket contact 12. A pair of metal compression set-screws 13 is threaded into the body of contact 12, and when tightened against the cable end, provide mechanical fastening as well as electrical contact. Alternatively, the cable end of contact 12 may be provided with solder or crimp type electrical connector 55, as shown in FIG. 6.

A threaded post or stud 58 is located at the end of pin contact 23 opposite the fingers 40 and is adapted to accept a ring lug (not shown). Alternatively, the end may be fashioned as a straight buss 57 with through holes (as shown in FIG. 5) or by soldering or mechanical crimping.

The pin and socket contacts shown herein are interchangeable with the plug or receptacle shells of their respective size and current rating. Each contact is easily installed into its respective plastic shell with the use of single press-fit plastic pins 51, 52. A thermoplastic cable strain-relief 53 is threaded to the cable end of the shell of plug 10 and can accommodate a wide range of jacketed cable diameters. An elastomeric bushing 54, shown in FIG. 7, is located inside the strain relief fitting 53 and an external O-ring 55 around the outer jacket of plug 10 offers a water-resistant and environmentally-protective seal for the pair of connectors when mated.

While the present invention has been described with particular emphasis on high current applications, it is to be understood that the present invention may be equally utilized in circumstances involving small currents, without departing from the scope of the invention.

The plug and receptacle configuration of the invention thus described solves several problems known to exist in prior art electrical connector designs. Those skilled in the art will realize other advantages not described herein but contemplated within the scope of this invention, which is to be measured solely from the claims hereto appended.

What is claimed:

1. A single-pole electrical connector adapted for carrying high electrical current comprising:

a conductive receptacle member adapted to be coupled to an electrical cable;

a conductive plug member adapted to be coupled to an electrical cable;

said receptacle member incorporating a pin contact portion;

said pin contact portion including a longitudinally-extending cylindrical rod-like member with a free end, said rod-like member having an external diameter at the free-end, said rod-like member being coaxial with said pin contact portion and having a portion with a diameter smaller than the diameter of said rod-like member at the end opposite said free end;

said plug member incorporating a cylindrical socket contact portion having an internal diameter;

said receptacle member and said plug member being adapted for sliding mechanical engagement along a common longitudinal axis;

said rod-like member having one or more slots formed therein to form at least one pair of resilient finger members by fabricating at least one diametrical slot extending across the external diameter of said rod-like member and through the portion of said rod-like member having a smaller diameter than the diameter of said rod-like member;

said rod-like member having an external diameter slightly larger than the internal diameter of said socket contact portion prior to having the slots formed therein;

each of said finger members extending radially outwardly relative to the longitudinal axis of said pin contact portion as a result of the slots contained therein, whereby the external diameter of a pair of opposite finger members is greater relative to said external diameter of said rod-like member before the formation of said slots;

said finger members being further adapted to be compressed in a radial direction and to engage a corresponding surface of said socket contact member when said receptacle member and said plug member are engaged.

2. A single-pole electrical connector as set forth in claim 1, further comprising:

a first locking mechanism provided on a first one of said members adapted to engage a second locking mechanism on the second member, whereby said first and second members are locked when engaged.

3. A single-pole electrical connector as set forth in claim 1, wherein:

said finger members comprise individual fingers extending longitudinally along the axis of the body of said pin contact member.

4. A single-pole electrical connector as set forth in claim 3, wherein:

each of said fingers has a free end and a fixed end, said fixed end being joined to the body of said pin contact member.

5. A single-pole electrical connector as set forth in claim 4, wherein:

said corresponding surface of said contact member comprises a bore formed therein having a portion with an internal diameter slightly smaller than the external radial diameter of said fingers;

the free end of each of said fingers being in contacting relationship with said internal bore when said receptacle member and said plug member are engaged.

6. A single-pole electrical connector as set forth in claim 5, wherein:

the free end of each of said fingers is slightly depressed in a radial direction when said receptacle member and said plug member are engaged; the degree of said depression being limited so that it is within the elastic limit of the material from which said fingers are formed.

7. A single-pole electrical connector as set forth in claim 2, wherein;

said first locking mechanism comprises at least one pin and said second locking mechanism comprises at least one slot adapted to receive said pin.

8. A single-pole electrical connector as set forth in claim 7, wherein;

said first locking mechanism is provided on said receptacle member and said second locking mechanism is provided on said plug member.

9. A single-pole electrical connector as set forth in claim 8, wherein:

said slot is formed within the surface of said contact member which incorporates said bore.

10. A single-pole electrical connector as set forth in claim 9, wherein:

said slot is L-shaped, having a first portion parallel to the longitudinal axis of said plug member and a second portion perpendicular thereto, said pin being adapted to communicate with said first portion when said receptacle member and said plug member are first engaged and with said second portion when said receptacle member and said plug member are locked.

* * * * *